US007965024B2

(12) United States Patent
Jeong

(10) Patent No.: US 7,965,024 B2
(45) Date of Patent: Jun. 21, 2011

(54) ELECTRON EMISSION DEVICE AND METHOD OF MANUFACTURING THE SAME

(75) Inventor: Kwang-Seok Jeong, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 692 days.

(21) Appl. No.: 11/790,196

(22) Filed: Apr. 24, 2007

(65) Prior Publication Data

US 2007/0252507 A1 Nov. 1, 2007

(30) Foreign Application Priority Data

Apr. 26, 2006 (KR) ..... 10-2006-0037677

(51) Int. Cl.
*H01J 1/62* (2006.01)

(52) U.S. Cl. ..... 313/309; 313/495

(58) Field of Classification Search ..... 313/309, 313/336, 351

See application file for complete search history.

(56) References Cited

U.S. PATENT DOCUMENTS

| | | | | |
|---|---|---|---|---|
| 7,094,692 | B2 * | 8/2006 | Horibe et al. | 438/680 |
| 2005/0046322 | A1 * | 3/2005 | Kim et al. | 313/309 |
| 2006/0043872 | A1 * | 3/2006 | Jeong | 313/495 |
| 2007/0114905 | A1 * | 5/2007 | Kurachi et al. | 313/311 |

FOREIGN PATENT DOCUMENTS

JP 2000-223016 * 8/2000

OTHER PUBLICATIONS

Yotani et al., "Emission Enhancement by Eximer Laser Irradiation over a Weblike Carbon Nanotube Layer", Japanese Journal of Applied Physics, vol. 43, No. 11B, 2004, pp. L1459-L1462.*

* cited by examiner

*Primary Examiner* — Joseph L Williams
*Assistant Examiner* — Brenitra M Lee
(74) *Attorney, Agent, or Firm* — Lee & Morse, P.C.

(57) ABSTRACT

An electron emission device includes a substrate, a first electrode on the substrate, a second electrode electrically insulated from the first electrode, a first insulating layer between the first electrode and the second electrode, an electron emission source hole in the first insulating layer and the second electrode to expose the first electrode, and an electron emission source having a first electron emission material layer on the first electrode in the electron emission source hole and a second electron emission material layer on the first electron emission material layer.

19 Claims, 4 Drawing Sheets

ELECTRON EMISSION DEVICE AND METHOD OF MANUFACTURING THE SAME

BACKGROUND OF THE INVENTION

1. Field of the Invention

The present invention relates to an electron emission device and a method of manufacturing the same. More particularly, the present invention relates to an electron emission device having improved electron emission efficiency, extended lifetime, and improved electron emission uniformity, and a method of manufacturing the same.

2. Description of the Related Art

In general, electron emission devices may use a thermionic cathode or a cold cathode as an electron emission source. The types of electron emission devices that use cold cathodes may include field emission (FED) devices, surface conduction emitter (SCE) devices, metal-insulator-metal (MIM) devices, metal-insulator-semiconductor (MIS) devices, and ballistic electron surface emitting (BSE) devices.

FED devices use the principle that electrons may be readily emitted due to a field emission difference in a vacuum when a material having a low work function or a high β function is used as an electron emission source. FED devices employ electron emission sources formed of a material utilizing, e.g., molybdenum, silicon, etc., as the main material having a sharp tip, a carbon material, e.g., graphite, diamond like carbon (DLC), etc., or a nano material, e.g., nano tubes, nano wires, etc.

SCE devices use the principle that electrons may be emitted from fine cracks, which are electron emission sources, when a current flows through a surface of the conductive thin film by applying a voltage to the first and second electrodes. SCE devices employ electron emission sources in which fine cracks may be formed on a conductive thin film after the conductive thin film is formed between first and second electrodes facing each other on a substrate.

MIM and MIS devices employ electron emission sources respectively having MIM and MIS structures, where electrons may be emitted and accelerated toward a metal having a low electron potential from a metal or a semiconductor having a high electron potential when a voltage is applied between both metals or a metal and a semiconductor which are located interposing a dielectric layer.

BSE devices use electrons that are not dispersed, but run straight in a direction when the size of a semiconductor is reduced to a dimension less than a mean free path distance of electrons in the semiconductor. BSE devices employ an electron emission source that may emit electrons when a voltage is applied to an ohmic electrode and a metal thin film after an electron supplying layer made from a metal or a semiconductor is formed on the ohmic electrode, and an insulating layer and the metal thin film are formed on the electron supplying layer.

FIG. 1 illustrates a partial exploded perspective view of a double FED type electron emission device, FIG. 2 is a cross-sectional view taken along line II-II of FIG. 1, and FIG. 3 is an enlarged view of portion III of FIG. 2.

Referring to FIGS. 1 through 3, an electron emission device 101 may include a first substrate 110, cathodes 120, gate electrodes 140, a first insulating layer 130, and electron emission sources 150. The electron emission device 101 may face a front panel 102 spaced apart with spacers 60.

The first substrate 110 may be a board having a predetermined thickness. The cathodes 120 may extend in a direction on the first substrate 110. The gate electrodes 140 may cross the cathodes 120. The first insulating layer 130 may be interposed between the gate electrodes 140 and the cathode 120 in order to insulate the cathodes 120 from the gate electrodes 140. Electron emission source holes 131 may be found in the first insulating layer 130.

The electron emission sources 150 may be electrically connected to the cathode 120. The electron emission sources may be formed of, e.g., a carbon material, a nano material, etc.

The electron emission device 101 may be used as an electron emission display device 100 forming a display cell 103 which generates visible light to realize images. In order to be used as a display device, a phosphor layer 70 may be further included on a front surface of the electron emission device 101. The phosphor layer 70 may be installed together with an anode 80 which accelerates electrons towards the phosphor layer 70. A front substrate 90 may support the anode 80 and the phosphor layer 70.

In the electron emission display device 100 having the above structure, the electron emission sources 150 that include an electron emission material, e.g., a carbon material, a nano material, etc., may be manufactured by using a direct growing method, e.g., a printing method, a chemical vapor deposition (CVD) method, etc. However, when the electron emission material is grown using the above methods, the electron emission material forming the electron emission sources 150 may in many cases not be exposed on a surface of the electron emission sources 150, but may be buried in the electron emission sources 150. Also, even if the electron emission material is exposed on the surface of the electron emission source, the electron emission material may be agglomerated or grown in lateral directions.

If the electron emission material is not exposed to the outside, a smooth emission of electrons by a tip discharge effect may not be reached. Even when the electron emission material is exposed to the outside and agglomerated, electron emission efficiency may be reduced due to a screen effect. In this case, the screen effect may denote that when the electron emission material is agglomerated, the agglomerated electron emission material may perform as one electron emission material. Also, when the electron emission material is not agglomerated, but grown in lateral directions, considering that electrons must be emitted straight forward, there may be a high possibility of non-uniform emission of electrons.

Accordingly, there is a need to improve the problem of reduced brightness due to a non-uniform electron emission or reduced electron emission characteristics.

The above information disclosed in this Background section is only for enhancement of understanding of the background of the invention, and therefore it may contain information that does not form the prior art that is already known in this country to a person of ordinary skill in the art.

SUMMARY OF THE INVENTION

The present invention is therefore directed to an electron emission device and method of manufacturing thereof, which substantially overcomes at least one or more of the disadvantages of the related art.

It is therefore a feature of an embodiment of the present invention to provide an electron emission device having improved electron emission efficiency, and a method of manufacturing thereof.

It is therefore another feature of an embodiment of the present invention to provide electron emission device having extended lifetime, and a method of manufacturing thereof.

It is therefore another feature of an embodiment of the present invention to provide electron emission device having improved electron emission uniformity, and a method of manufacturing thereof.

At least one of the above and other features and advantages of the present invention may be realized by providing an electron emission device which may include a substrate, a first electrode on the substrate, a second electrode electrically insulated from the first electrode, a first insulating layer between the first electrode and the second electrode, an electron emission source hole in the first insulating layer and the second electrode to expose the first electrode, and an electron emission source having a first electron emission material layer on the first electrode and a second electron emission material layer on the first electron emission material layer.

The first electron emission material layer may be electrically connected to the first electrode. The device may further include a catalyst layer on the first electron emission material layer. The catalyst layer may be a metal or a metal salt. The metal or metal salt may be at least one of Fe, Ni, Co, or Y. The catalyst layer may be formed between the first electrode and the first electron emission material layer. The metal or metal salt may include at least one of Fe, Ni, Co, or Y. The second electron emission material layer may have an electron emission material density smaller than the density of the first electron emission material layer. The device may further include a second insulating layer covering an upper part of the second electrode, and a focusing electrode that may be insulated from the second electrode by the second insulating layer and may be parallel to the second electrode. The first electrode may include at least one material selected from Al, Ti, Cr, Ni, Au, Ag, Mo, W, Pt, Cu, Pd, Ru, $RuO_2$, ITO, $In_2O_3$, $SnO_2$, or polysilicon. The first and second electron emission material layers may be formed from at least one of a carbon material or a nano material. The carbon material or nano material may be at least one of carbon nano tubes having a low work function and a high β function, graphite, diamond, diamond like carbon, carbon nano wires, or carbon nano rods.

At least one of the above and other features and advantages of the present invention may be realized by providing a method of manufacturing an electron emission device which may include forming a first electron emission material layer electrically connected to an electrode, forming a catalyst layer on the first electron emission material layer, and growing a second electron emission material from the catalyst layer.

The forming of the first or the growing of the second electron emission material from the catalyst layer may be performed using a chemical vapor deposition direct growing method. In the forming of the catalyst layer on the first electron emission material layer, the catalyst layer may be formed to have a corrugated rough upper surface so that the second electron emission material has a density smaller than that of the first electron emission material layer when the second electron emission material is grown. The catalyst layer may be formed by coating a solution on a seed layer, and drying the solution. The solution may include at least one metal salt formed from at least one of Fe, Ni, Co, or Y. The solution may include at least one of acetate, oxalate or carbonate. The solution may include at least one solvent selected from ethylene glycol or ethanol.

BRIEF DESCRIPTION OF THE DRAWINGS

The above and other features and advantages of the present invention will become more apparent to those of ordinary skill in the art by describing in detail exemplary embodiments thereof with reference to the attached drawings, in which.

DETAILED DESCRIPTION OF THE INVENTION

Figure 1:
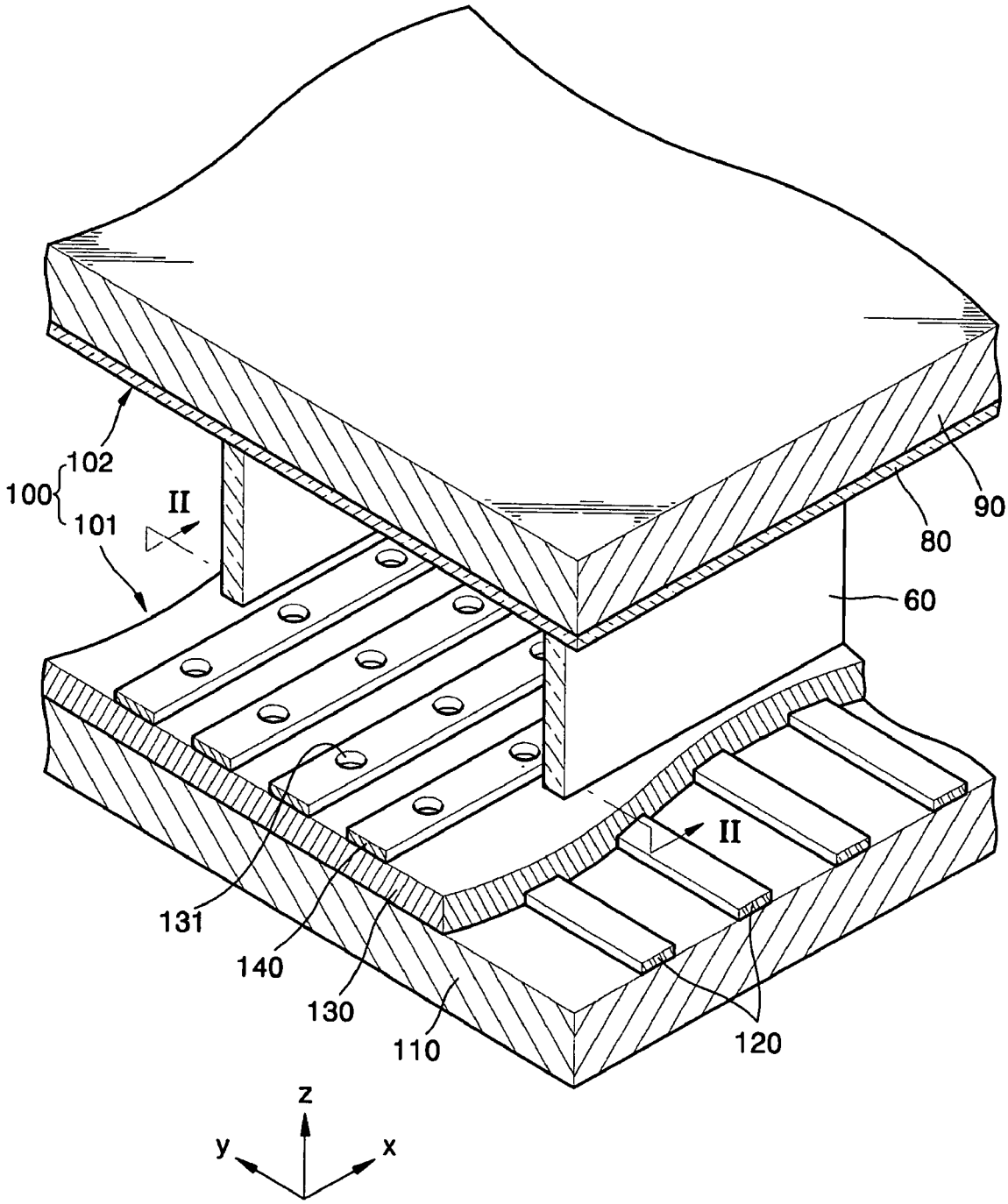
FIG. 1 (RELATED ART)
FIG. 1 illustrates a partial exploded perspective view of a double field emission device (FED) type of electron emission device.
Figure 2:
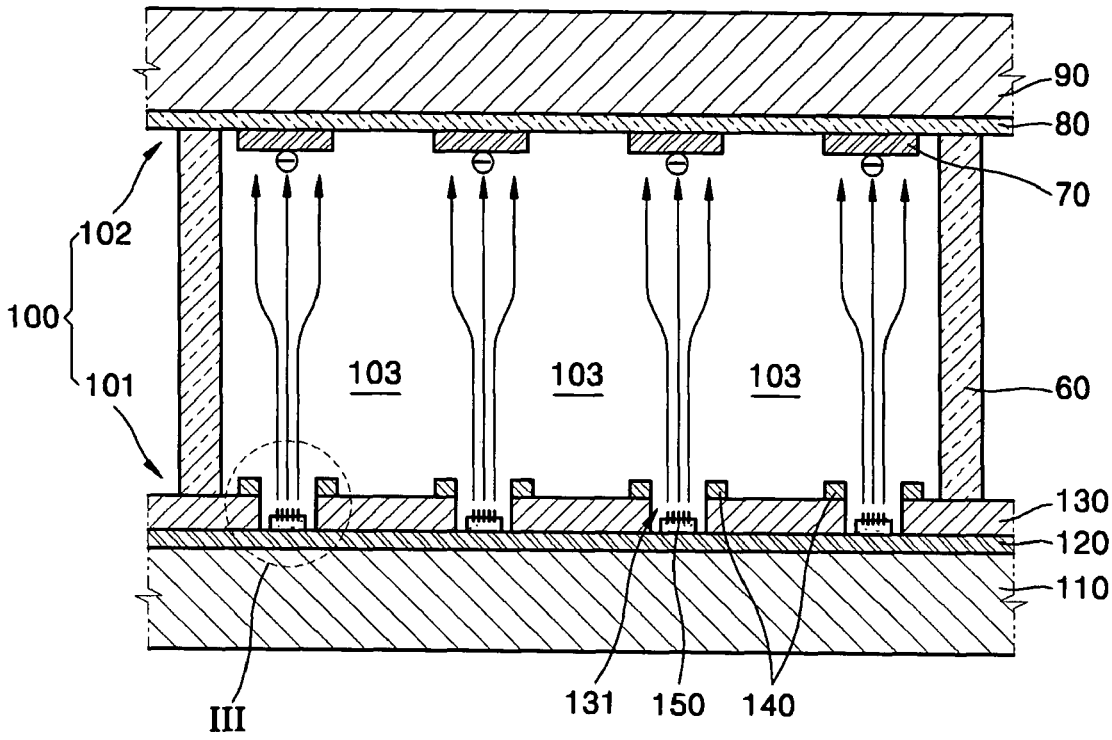
FIG. 2 (RELATED ART)
FIG. 2 illustrates a cross-sectional view taken along line II-II of FIG. 1.
Figure 3:
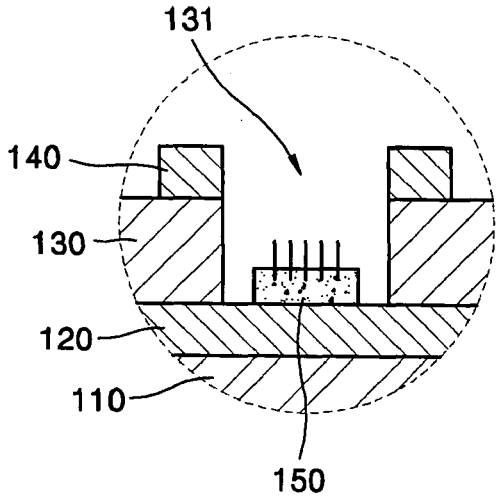
FIG. 3 (RELATED ART)
FIG. 3 illustrates an enlarged view of portion III of FIG. 2.

Korean Patent Application No. 10-2006-0037677, filed on Apr. 26, 2006, in the Korean Intellectual Property Office, and entitled: "Electron Emission Device and Method of Manufacturing the Same," is incorporated by reference herein in its entirety.

The present invention will now be described more fully hereinafter with reference to the accompanying drawings, in which exemplary embodiments of the invention are illustrated. The invention may, however, be embodied in different forms and should not be construed as limited to the embodiments set forth herein. Rather, these embodiments are provided so that this disclosure will be thorough and complete, and will fully convey the scope of the invention to those skilled in the art.

In the drawing figures, the dimensions of layers and regions may be exaggerated for clarity of illustration. It will also be understood that when a layer or element is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Like reference numerals refer to like elements throughout.

The present invention provides an electron emission device in which a carbon material or a nano material forming an electron emission source may be uniformly distributed and formed facing upwards, through which uniform electron emission may be achieved and electron emission efficiency is increased, and a method of manufacturing the electron emission device.

Figure 4:
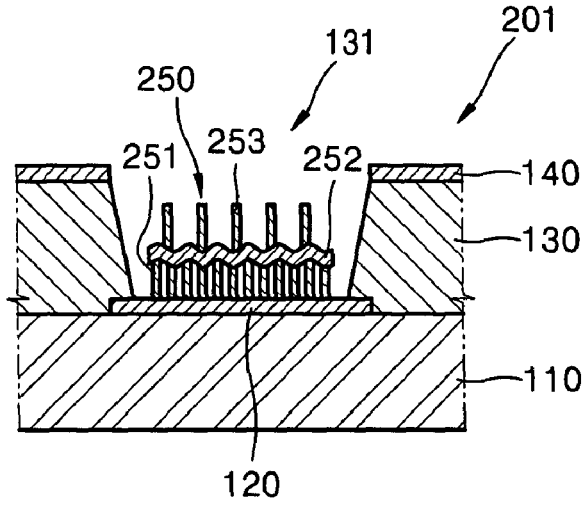
FIG. 4 illustrates a cross-sectional view of an electron emission device according to an embodiment of the present invention.

FIG. 4 illustrates a cross-sectional view of an electron emission device 201 according to an embodiment of the present invention.

Referring to FIG. 4, the electron emission device 201 may include a first substrate 110, a cathode 120, a gate electrode 140, a first insulating layer 130, and an electron emission source 250.

The first substrate 110 may be a board member having a predetermined thickness, and may be, e.g., a glass substrate formed of quartz, glass containing small amounts of impurities such as Na, sheet glass, glass coated with $SiO_2$, borosilicate glass, phosphate glass, an aluminum oxide substrate, a ceramic substrate, etc. In order to obtain a flexible display apparatus, the first substrate 110 may be formed of a flexible material.

The cathode 120 may extend in a direction on the first substrate 110, and may be formed of an electrically conductive material, e.g., a metal including at least one of Al, Ti, Cr, Ni, Au, Ag, Mo, W, Pt, Cu, Pd, Ru, etc. The cathode 120 may also be formed from an alloy or oxide of these metals, e.g., $RuO_2$, Pd—Ag, etc., a printed conductive material including a metal oxide and glass, a transparent conductive material, e.g., ITO, $In_2O_3$, or $SnO_2$, etc., or a semiconductor material, e.g., polysilicon.

The gate electrode 140 may be insulated from the cathode 120 by the first insulating layer 130. The gate electrode 140 may be formed of an electrically conductive material similar to the cathode 120. The first insulating layer 130 may be interposed between the gate electrode 140 and the cathode 120 to insulate the gate electrode 140 from the cathode 120, thereby preventing short circuits between the electrodes.

The electron emission source 250 may be in an electron emission source hole 131, which may be formed in the first insulating layer 130 and the gate electrode 140. The electron emission source hole 131 may expose a portion of the cathode 120, allowing the electron emission source 250 to be electrically connected to the cathode 120. The electron emission source 250 may include a first electron emission material layer 251 electrically connected to the cathode 120 and a second electron emission material 253 grown on an upper part of the first electron emission material layer 251. A catalyst layer 252 used for growing the second electron emission material 253 may optionally be on the upper part of the first electron emission material layer 251.

The first electron emission material layer 251 may be formed using, e.g., a chemical vapor deposition (CVD) direct growing method on the cathode 120, but the present invention is not limited thereto. The catalyst layer 252 may be formed of a metal or a metal salt. When the catalyst layer 252 is formed of a metal salt, the catalyst layer 252 may be formed by coating a solution on a predetermined seed layer, followed by drying. The solution may be formed from the metal salt dissolved in a predetermined solvent. The solution may be coated on the predetermined seed layer (not shown) using, e.g., a spin coating method, a dipping method, etc.

The metal salt may contain weak acid negative ion radicals so that the salt may be dissolved in a strong salt developing solution such as tetramethylammonium hydroxide (TMAH). The weak acid negative ion radicals may be at least one selected from, e.g., acetate radicals, oxalate radicals, formate radicals, propionate radicals, butyrate radicals, carbonate radicals, etc. Also, the metal salt may be formed from at least one of, e.g., Fe, Ni, Co, Y, etc. The solvent may be one of, e.g., ethylene glycol, propylene glycol, methanol, ethanol, etc. The metal salt may have a solubility of approximately 1 mM or more with respect to the solvent at room temperature. Also, the metal salt may be insoluble in, e.g., acetone, isopropyl alcohol, a photoresist strip, etc.

In the electron emission sources 250, an uppermost part of the second electron emission material 253 may be located lower than the top or bottom surfaces of the gate electrode 140. The first and second electron emission material layers 251 and 253 used for the electron emission sources 250 may be formed of, e.g., a carbon material, a nano material, etc. The carbon material may be, e.g., carbon nano tubes (CNTs) having a low work function and a high β function, graphite, diamond, diamond like carbon (DLC), etc. The carbon material may also be, e.g., nano materials including CNTs, nano wires, nano rods, etc. In particular, the CNTs have an electron emission characteristic, and thus permit driving of an electron emission display device at a low voltage. Therefore, the use of the CNTs as an electron emission source may be advantageous for manufacturing a large screen display device.

In the electron emission device 201 having the above-described structure, electrons may be emitted from the electron emission sources 250 due to an electric field formed between the cathode 120 and the gate electrode 140 when a negative voltage is applied to the cathode 120 and a positive voltage is applied to the gate electrode 140.

Also, the electron emission device 201 may be utilized in an electron emission display device that creates images by generating visible light. In order to function as a display device, the electron emission device 201 may further include a phosphor layer (not shown) on a front surface of the electron emission device 201. The phosphor layer may be formed together with an anode (not shown) that accelerates electrons towards the phosphor layer, and a front substrate (not shown) that supports the anode and the phosphor layer.

The second substrate, i.e., the front substrate, may be a board member having a predetermined thickness, and may be formed of the same materials as the first substrate 110. The anode may be formed of an electrically conductive material similar to the material forming the cathode 120 and the gate electrode 140.

The phosphor layer may be formed of a cathode luminescence (CL) type of phosphor material that may generate visible light when the phosphor layer is excited by accelerated electrons. The phosphor material that may be used for the phosphor layer includes, e.g., a red color phosphor material such as $SrTiO_3$:Pr, $Y_2O_3$:Eu, $Y_2O_3S$:Eu, etc., a green color phosphor material such as $Zn(Ga, Al)_2O_4$:Mn, $Y_3(Al, Ga)_5O_{12}$:Tb, $Y_2SiO_5$:Tb, ZnS:Cu,Al, etc., and a blue color phosphor material such as $Y_2SiO_5$:Ce, ZnGa2$O_4$, ZnS:Ag, Cl, etc., but the phosphor material of the present invention is not limited thereto.

In order to display images, i.e., to not simply function as a lamp that generates visible light, the cathode 120 and the gate electrode 140 may be alternately arranged. Also, in regions where the cathode 120 and the gate electrode 140 are alternately arranged, the electron emission source hole 131 may be formed to contain the electron emission source 250 therein.

The electron emission device 201, which includes the first substrate 110 and the front panel 102 (see FIG. 1) that includes the second substrate 90, may form a vacuum space while maintaining a predetermined distance from each other. Spacers 60 may maintain a predetermined distance between the electron emission device 201 and the front panel 102. The spacers 60 may be formed of an insulating material. Also, the space that is formed between the electron emission device 201 and the front panel 102 may be sealed, e.g., by applying a frit around the space and exhausting air in the space to form a vacuum.

Operation of the electron emission display device 100 having the above structure will now be described.

A negative (−) voltage may be applied to the cathode 120 and a positive (+) voltage may be applied to the gate electrode 140 so that the electron emission source 250 formed on the cathode 120 may emit electrons. Also, a high positive (+) voltage may be applied to the anode 80 to accelerate the electrons toward the anode 80. When the high positive (+) voltage is applied to the anode 80, the electrons emitted from the electron emission source 250 may proceed toward the gate electrode 140 and accelerate towards the anode 80. The electrons accelerated towards the anode 80 may collide with the phosphor layer 70. Then, the phosphor material of the phosphor layer 70 may become excited and emit visible light. The portion of the electron emission source 250 that mainly emit electrons may be the upper parts of the second electron emission material 253.

A method of manufacturing an electron emission device 201 according to an embodiment of the present invention will now be described with reference to FIGS. 5 through 7.

Figure 5:
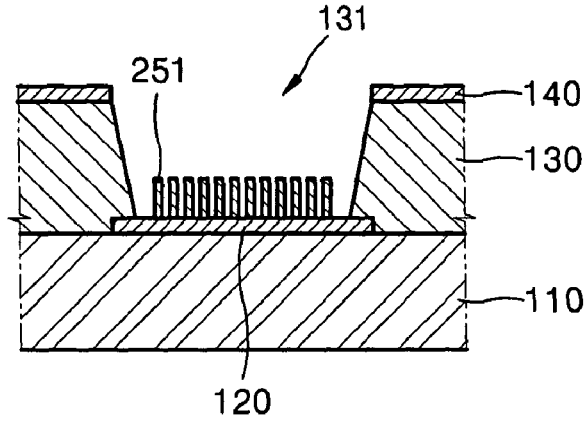
FIGS. 5 through 7 illustrate cross-sectional views of stages of a method of manufacturing an electron emission device according to an embodiment of the present invention.
Figure 6:
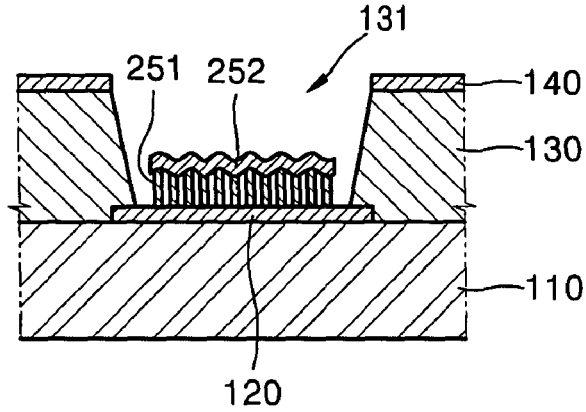
Figure 7:
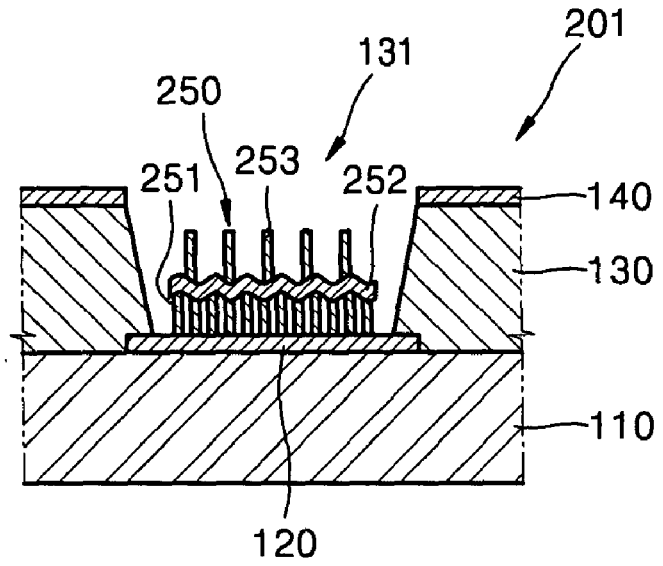

FIGS. 5 through 7 illustrate cross-sectional views of stages of a method of manufacturing an electron emission device according to an embodiment of the present invention. The cathode 120, the insulating layer 130, and the gate electrode 140 may be formed on a substrate 110. The electron emission source hole 131 may be formed using a conventional method. In the method of manufacturing the electron emission device 201, the electron emission source 250 may be formed in the electron emission source hole 131 by the following method.

Referring to FIG. 5, the first electron emission material layer 251 may be formed on an upper part of the cathode 120 in the electron emission source hole 131. The first electron emission material layer 251 may be formed using, e.g., a printing method, a CVD direct growing method, etc. When the CVD direct growing method is used, the cathode 120 may be used as a catalyst layer. Alternately, an additional catalyst layer may be formed on the cathode 120.

Referring to FIG. 6, the catalyst layer 252 may be formed on the first electron emission material layer 251. The catalyst layer 252 may be formed using the materials as described above.

Referring to FIG. 7, a second electron emission material 253 formed of, e.g., a carbon material, a nano material, etc., may be formed on the catalyst layer 252 using, e.g., a CVD direct growing method.

Since an upper surface of the first electron emission material layer 251 has a corrugated surface, the catalyst layer 252 formed on the first electron emission material layer 251 may also have a corrugated rough upper surface. Accordingly, the second electron emission material 253 may have small grains, and a carbonization rate may thus be increased. Therefore, the density of the electron emission material formed on the catalyst layer 252 may be reduced, and accordingly, the causes that reduce the electron emission, e.g., a screen effect, may be avoided.

Figure 8:
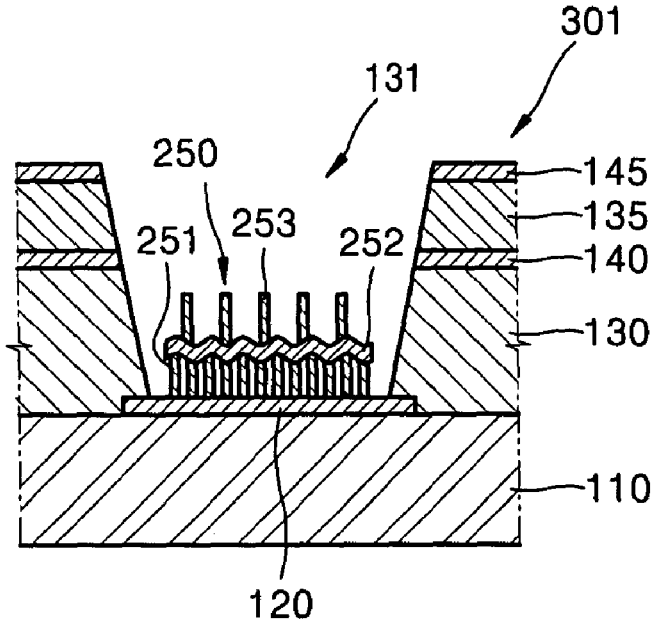
FIG. 8 illustrates a cross-sectional view of an electron emission device according to an embodiment of the present invention.

FIG. 8 illustrates a cross-sectional view of an electron emission device 301 according to an embodiment of the present invention.

Referring to FIG. 8, the electron emission device 301 may further include a second insulating layer 135 covering an upper part of the gate electrode 140. A focusing electrode 145 may be formed on an upper part of the second insulating layer 135. With the aid of the focusing electrode 145, electrons emitted by electron emission sources 250 may be focused on central portions of a phosphor layer (not shown) so as not to disperse laterally.

In the electron emission device 301 depicted in FIG. 8, an electron emission material layer may be formed as double layers, as is illustrated in FIG. 4. Therefore, the electron emission material may be uniformly distributed, thereby improving electron emission characteristics without the screen effect.

As described above, in the electron emission device according to the present invention, the electron emission characteristics of an electron emission material may be greatly improved and uniform electron emission may be achieved.

Exemplary embodiments of the present invention have been disclosed herein, and although specific terms are employed, they are used and are to be interpreted in a generic and descriptive sense only and not for purpose of limitation. Accordingly, it will be understood by those of ordinary skill in the art that various changes in form and details may be made without departing from the spirit and scope of the present invention as set forth in the following claims.

What is claimed is:

1. An electron emission device, comprising:

a substrate;

a first electrode on the substrate;

a second electrode electrically insulated from the first electrode;

a first insulating layer between the first electrode and the second electrode;

an electron emission source hole in the first insulating layer and the second electrode to expose the first electrode; and an electron emission source having a first electron emission material layer including a plurality of first electron emission materials overlapping the first electrode, and a second electron emission material layer including a plurality of second electron emission materials overlapping the first electron emission material layer, a density of the plurality of second electron emission materials on the first electron emission layer being smaller than a density of the plurality of first electron emission materials on the first electrode.

2. The electron emission device as claimed in claim 1, wherein the first electron emission material layer is electrically connected to the first electrode.

3. The electron emission device as claimed in claim 1, further comprising a catalyst layer overlapping the plurality of first electron emission materials and having a corrugated rough upper surface, each second electron emission material extends from the catalyst layer.

4. The electron emission device as claimed in claim 3, wherein the catalyst layer comprises a metal or a metal salt.

5. The electron emission device as claimed in claim 4, wherein the metal or metal salt comprises at least one of Fe, Ni, Co, or Y.

6. The electron emission device as claimed in claim 3, wherein a second catalyst layer is formed between the first electrode and the first electron emission material layer, each first electron emission material extends from the second catalyst layer.

7. The electron emission device as claimed in claim 6, wherein the catalyst layer comprises a metal or a metal salt.

8. The electron emission device as claimed in claim 4, wherein the metal or metal salt comprises at least one of Fe, Ni, Co, or Y.

9. The electron emission device as claimed in claim 1, further comprising:

a second insulating layer covering an upper part of the second electrode; and a focusing electrode that is insulated from the second electrode by the second insulating layer and is parallel to the second electrode.

10. The electron emission device as claimed in claim 1, wherein the first electrode comprises at least one material selected from Al, Ti, Cr, Ni, Au, Ag, Mo, W, Pt, Cu, Pd, Ru, $RuO_2$, ITO, $In_2O_3$, $SnO_2$, or polysilicon.

11. The electron emission device as claimed in claim 1, wherein each of the first and second electron emission material comprises one of a carbon material or a nano material.

12. The electron emission device as claimed in claim 11, wherein the carbon material or the nano material comprises at least one of carbon nano tubes having a low work function and a high β function, graphite, diamond, diamond like carbon, carbon nano wires, or carbon nano rods.

13. The electron emission device as claimed in claim 1, wherein the plurality of second electron emission materials is above an upper part of the first electron emission material layer.

14. The electron emission device as claimed in claim 13, wherein a catalyst layer having a corrugated rough upper surface is between the plurality of second electron emission materials and the upper part of the first electron emission material layer.

15. The electron emission device as claimed in claim 1, wherein a lower part of the second electron emission material layer is above an upper part of the first electron emission material layer, and the plurality of first and second electron emission materials extend in a same direction.

16. The electron emission device as claimed in claim 15, wherein a catalyst layer having a corrugated rough upper surface is between the lower part of the second electron emission material layer and the upper part of the first electron emission material layer.

17. A method of manufacturing an electron emission device, comprising:

forming a first electrode on a substrate;

forming a first insulating layer and a second electrode on the substrate, the second electrode being electrically insulated from the first electrode by the first insulating layer;

forming an electron emission source hole in the first insulating layer and the second electrode to expose the first electrode;

forming a first electron emission material layer including a plurality of first electron emission materials overlapping the first electrode; and forming a second electron emission material layer including a plurality of second electron emission materials overlapping the first electron emission material layer, a density of the plurality of second electron emission materials on the first electron emission layer being smaller than a density of the plurality of first electron emission materials on the first electrode.

18. The method as claimed in claim 17, wherein the second electron emission material is formed from a catalyst layer using a chemical vapor deposition direct growing method.

19. The method as claimed in claim 18, wherein the catalyst layer is formed on the first electron emission material layer and has a corrugated rough upper surface.

* * * * *